US006884081B1

(12) United States Patent
Ovadia

(10) Patent No.: US 6,884,081 B1
(45) Date of Patent: Apr. 26, 2005

(54) JEWELRY DISPLAY AND STORAGE BOX WITH REMOVABLE JEWELRY HOLDING MEMBERS AND MAGNETIC CLOSURE AND MAGNETIC STACKING ARRANGEMENT

(76) Inventor: Joseph Ovadia, 109 Long Hill Rd., Little Falls, NJ (US) 07424

( * ) Notice: Subject to any disclaimer, the term of this patent is extended or adjusted under 35 U.S.C. 154(b) by 0 days.

(21) Appl. No.: 10/740,046

(22) Filed: Dec. 18, 2003

(51) Int. Cl.[7] ..... A45C 11/04; B65D 1/34

(52) U.S. Cl. ..... 434/386; 206/6.1; 206/480; 206/566; 211/85.2

(58) Field of Search ..... 206/566, 6.1, 480, 206/481, 482, 483; 434/99, 386; 211/85.2

(56) References Cited

U.S. PATENT DOCUMENTS 1,418,798 A * 6/1922 Hirschl ..... 206/45.21
2,925,907 A * 2/1960 Grieve et al. ..... 206/6.1
2,963,149 A * 12/1960 Bergh et al. ..... 206/565
3,125,221 A * 3/1964 Ax ..... 206/562
4,011,942 A * 3/1977 Crosslen ..... 206/777
4,180,169 A * 12/1979 Michels ..... 211/85.2
4,282,975 A * 8/1981 Ovadia ..... 206/566
4,650,077 A * 3/1987 Droz ..... 206/566
4,799,588 A * 1/1989 Trisl ..... 206/301
5,087,105 A * 2/1992 White ..... 312/245
5,176,263 A * 1/1993 Caruso ..... 211/85.2
5,555,671 A * 9/1996 Voight et al. ..... 43/57.1
5,758,765 A * 6/1998 Ovadia ..... 206/6.1
6,000,547 A * 12/1999 Ovadia et al. ..... 206/566
6,056,130 A * 5/2000 Ovadia ..... 211/85.2
6,059,098 A * 5/2000 Ovadia et al. ..... 206/6.1
6,085,898 A * 7/2000 Ovadia et al. ..... 206/6.1

* cited by examiner

*Primary Examiner*—Derris H. Banks
*Assistant Examiner*—Dmitry Suhol
(74) *Attorney, Agent, or Firm*—Richard M. Goldberg

(57) ABSTRACT

A display and storage box includes an upper portion having a top wall and an upper side wall extending down from the top wall; a lower portion which together with the upper portion defines a closed box in an assembled configuration, the lower portion having a bottom wall, and a lower side wall extending up from the bottom wall; the top and bottom walls having a plurality of inwardly extending projections thereon; a plurality of jewelry holding members having openings for receiving the projections to removably retain the jewelry holding members on the upper portion and lower portion; and the upper portion and lower portion each have magnetic members mounted therein which have their magnetic poles oriented in a manner to attract the lower portion and upper portion toward each other when assembled together in a closed box configuration.

27 Claims, 11 Drawing Sheets

JEWELRY DISPLAY AND STORAGE BOX WITH REMOVABLE JEWELRY HOLDING MEMBERS AND MAGNETIC CLOSURE AND MAGNETIC STACKING ARRANGEMENT

BACKGROUND OF THE INVENTION

The present invention relates generally to display and storage devices, and more particularly, is directed to a display and storage box for displaying and storing articles, such as jewelry, gift items and other articles.

Boxes are known for display and storage of jewelry or gift items. Such boxes take many forms. For example, two halves can be hinged together at one edge. However, this requires additional parts such as a hinge and a latch assembly, thereby increasing the cost of the box. As another example, a box is known in which one part which holds the gift items is telescopically received in the other part. However, this box requires two parts of different sizes and shapes, thereby also increasing the cost of manufacture. Another box is known in which a bottom part has an inwardly spaced peripheral ledge, and the top or cover part seats thereon in surrounding relation with the ledge and in friction engagement therewith. However, this also requires two parts of different sizes and shapes, thereby also increasing the cost of manufacture.

Further, with conventional display and storage boxes, the article holding members are integrally fixed to the box. In order to use different article holding members, it is necessary to provide a different box, thereby increasing the cost and storage space needed. Also, if the article holding members become damaged, it is necessary to provide a new display and storage box.

SUMMARY OF THE INVENTION

Accordingly, it is an object of the present invention to provide a display and storage box that overcomes the problems with the aforementioned prior art.

It is another object of the present invention to provide a display and storage box with two halves of the same size and shape that fit on each other and are magnetically held together.

It is still another object of the present invention to provide such display and storage boxes which can be stacked together and magnetically held in the stacked arrangement.

It is yet another object of the present invention to provide a display and storage box in which the article holding members are removably held to the box.

It is a further object of the present invention to provide a display and storage box that has a plurality of pins for removably securing different article holding members thereto.

It is a further object of the present invention to provide a display and storage box that is easy and economical to manufacture and use.

In accordance with an aspect of the present invention, a display and storage box includes an upper portion having a top wall and an upper side wall extending down from the top wall; a lower portion which together with the upper portion defines a closed box in an assembled configuration, the lower portion having a bottom wall, and a lower side wall extending up from the bottom wall; at least one of the bottom wall and top wall having a plurality of inwardly extending projections thereon; and at least one article holding member having at least one opening for receiving at least one projection to removably retain the at least one article holding member on a respective one of the upper portion and lower portion.

Preferably, the plurality of projections include at least one pin, and more preferably, there are a plurality of pairs of the pins extending from at least one of the bottom wall and top wall.

The at least one article holding member preferably includes a base portion having the at least one lower opening, and an upstanding portion extending from the base portion for holding an article thereon. In one embodiment, the upstanding portion includes an arrangement for holding a jewelry item thereon. For example, the upstanding portion can include at least one opening for holding a pierced earring. Alternatively, the upstanding portion can include at least one finger for holding a pendant. As a further alternative, the upstanding portion can include an at least part arcuate structure for holding a ring. Also, the at least one article holding member can further include a reinforcing member for connection between the base portion and the upstanding portion to reinforce the upstanding portion. Preferably, the upstanding portion extends from the base portion at an acute angle.

Where both the bottom wall and top wall having a plurality of the projections thereon, the projections are preferably arranged on the bottom wall and top wall such that article holding members retained on the bottom wall are interleaved with article holding members retained on the top wall when the upper portion and lower portion are assembled together in a closed box configuration.

In addition, the upper portion and lower portion each have magnetic members mounted therein which have their magnetic poles oriented in a manner to attract the lower portion and upper portion toward each other when assembled together in a closed box configuration. The magnet members are arranged at periodic intervals along the upper side wall and lower side wall. Where the upper portion and lower portion each have corner sections, the magnets are positioned at the corner sections. In addition, the magnets have their magnetic poles oriented in a manner to attract a second the display and storage box stacked thereon.

As a further alternative, the upper portion and lower portion are hinged together by a hinge at a common edge.

In accordance with another aspect of the present invention, a display and storage box includes an upper portion having a top wall, and an upper side wall extending down from the top wall; a lower portion which together with the upper portion defines a closed box in an assembled configuration, the lower portion having a bottom wall, and a lower side wall extending up from the bottom wall; and each of the upper portion and lower portion have magnetic members mounted therein which have their magnetic poles oriented in a manner to attract the lower portion and upper portion toward each other when assembled together in a closed box configuration.

The above and other objects, features and advantages of the invention will become readily apparent from the following detailed description thereof which is to be read in connection with the accompanying drawings.

DETAILED DESCRIPTION

Figure 1:
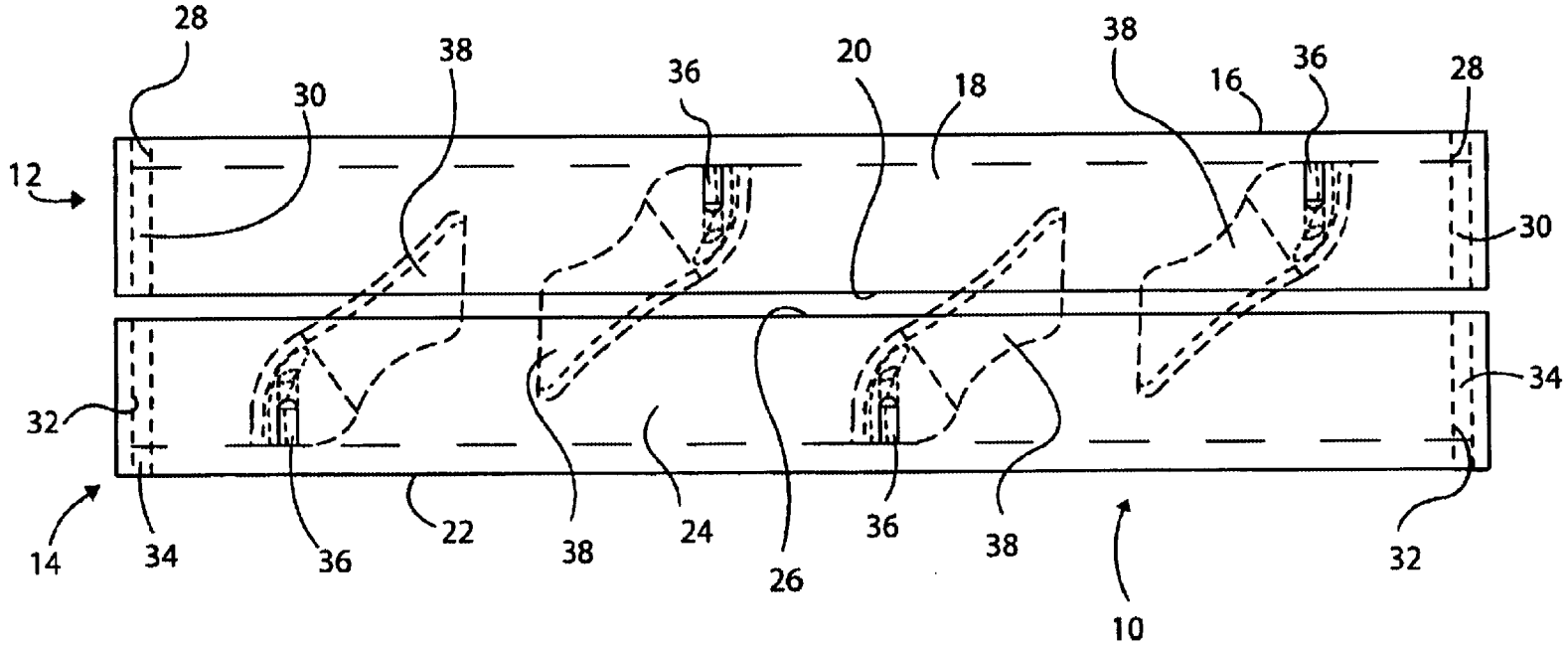
FIG. 1 is a perspective view of a display and storage box according to the present invention, in a partially assembled condition.
Figure 2:
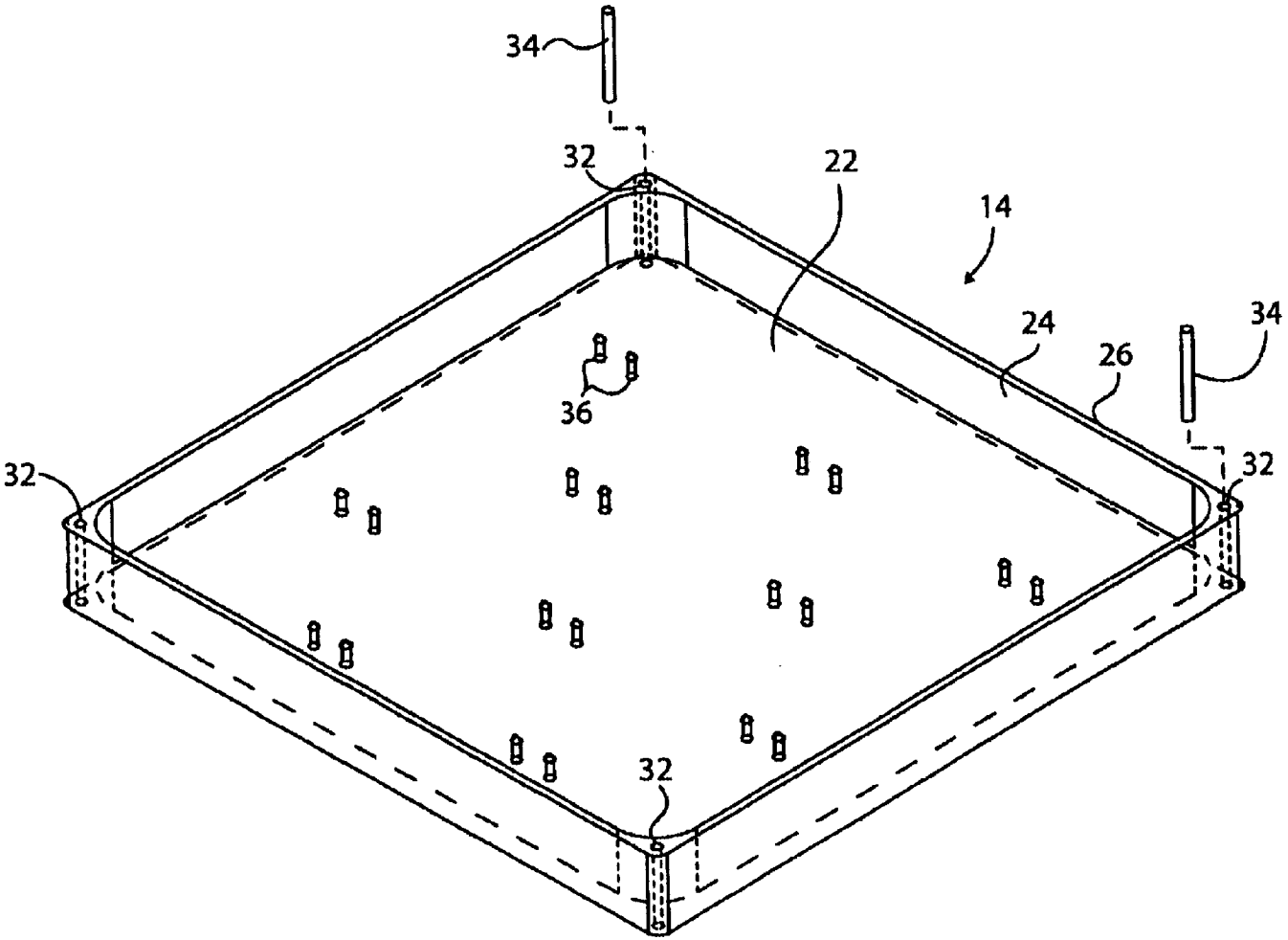
FIG. 2 is a perspective view of the lower tray of the display and storage box of FIG. 1.
Figure 3:
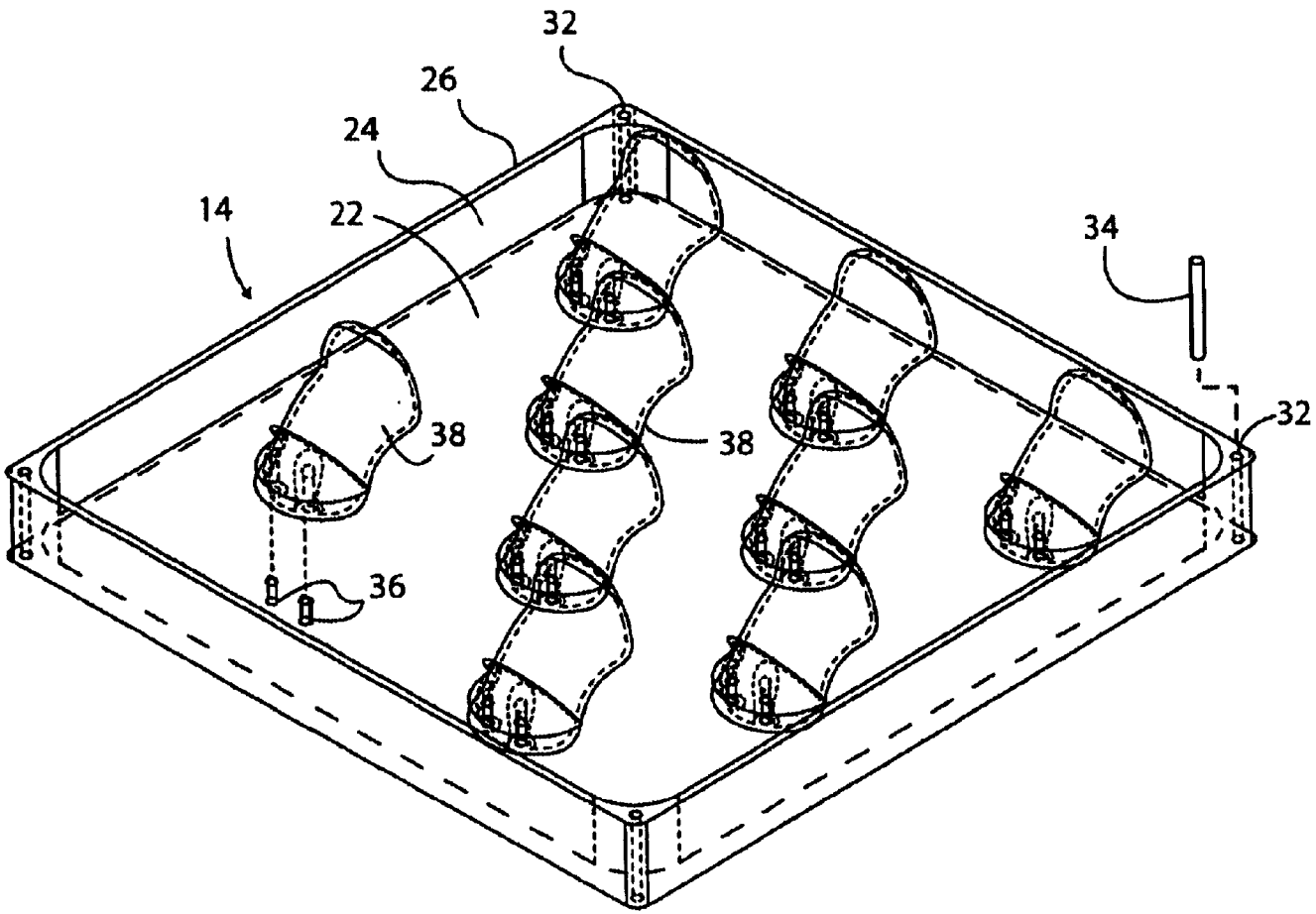
FIG. 3 is a perspective view of the lower tray of FIG. 2 with ring fingers removably assembled thereon.
Figure 4:
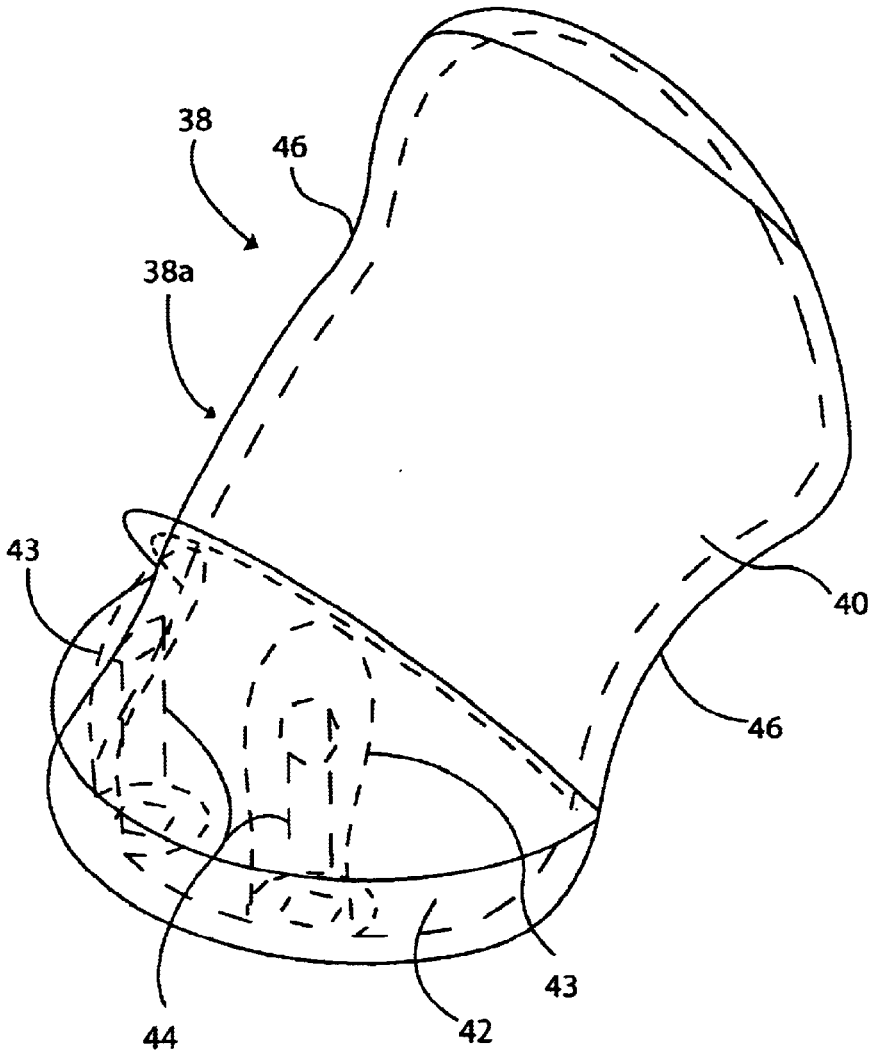
FIG. 4 is a perspective view of a jewelry holding member formed as a ring finger, that can be used with the display and storage box according to the present invention.

Referring to the drawings in detail, a display and storage box 10 according to the present invention includes an upper tray 12 and a lower tray 14 of identical size and shape which are adapted to close upon each other.

Upper tray 12 includes a top supporting wall 16 of a generally rectangular configuration. However, it will be appreciated that the present invention is not limited thereby, and top wall 16 can have any other suitable configuration, such as circular, oval, triangular, etc. An upper side wall 18 extends down at right angles from the periphery of top wall 16. However, the present invention is not limited thereby, and upper side wall 18 can extend downwardly from a position spaced inwardly from the periphery of top wall 16, and can extend down at an angle other than a right angle therefrom. Upper side wall 18 includes a lower facing edge 20.

In like manner, lower tray 14 includes a bottom supporting wall 22 of a generally rectangular configuration. However, it will be appreciated that the present invention is not limited thereby, and bottom wall 22 can have any other suitable configuration, such as circular, oval, triangular, etc. A lower side wall 24 extends up at right angles from the periphery of bottom wall 22. However, the present invention is not limited thereby, and lower side wall 24 can extend upwardly from a position spaced inwardly from the periphery of bottom wall 22, and can extend up at an angle other than a right angle therefrom. Lower side wall 24 includes an upper facing edge 26 of the same dimensions and shape as lower facing edge 20 in order to engage therewith to form a closed box. Specifically, lower side wall 24 has outer dimensions which are the same as outer dimensions of upper side wall 18 so as to form a smooth continuation thereof. When upper tray 12 is assembled with lower tray 14, lower facing edge 20 rests on upper facing edge 26 to form a closed box.

Thus, with the above arrangement, upper tray 12 and lower tray 14 can be assembled together to form a closed box having a substantially continuous outer surface.

Figure 8:
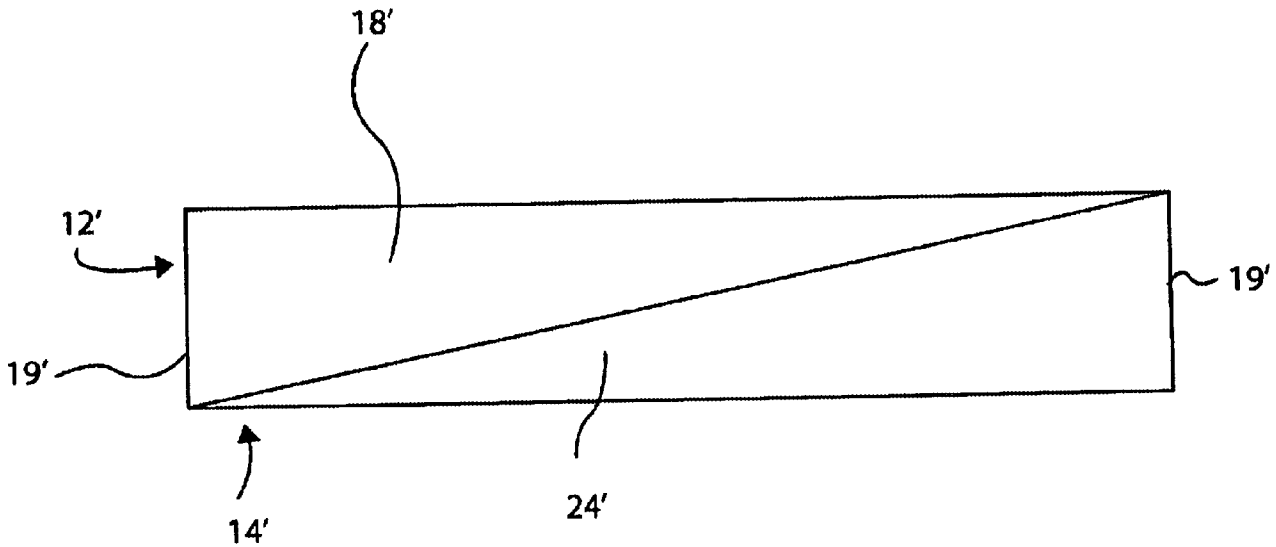
FIG. 8 is a side elevational view of a modified display and storage box according to the present invention.

The side walls need not be of a constant height. For example, as shown in the side elevational view of FIG. 8, opposing side walls 18' and 24' can have a triangular configuration, meeting a high rear wall 19'. In such case, upper tray 12' and lower tray 14' would mate to form a rectangular box.

In order to hold upper tray 12 in fixed relation to lower tray 14, upper tray 12 is provided with four corner bores 28. Although bores 28 are shown to be of a cylindrical configuration, the present invention is not limited thereby, and bores 28 can have any other cross-sectional configuration, such as square, rectangular, polygonal, triangular, etc. Preferably, bores 28 extend along the entire height of upper side wall 18, although bores 28 can be of a lesser height. Magnets 30 having the same dimensions as bores 28 are friction fit within bores 28, with one end of each magnet 30 having a first polarity and the opposite end of each magnet 30 having an opposite polarity. For example, the end of each magnet 30 closest to lower facing edge 20 can have a North polarity while the end closest to top wall 16 can have a South polarity. Alternatively, two separate magnets can be provided in each bore 28 with the aforementioned polarity arrangements.

Figure 11:
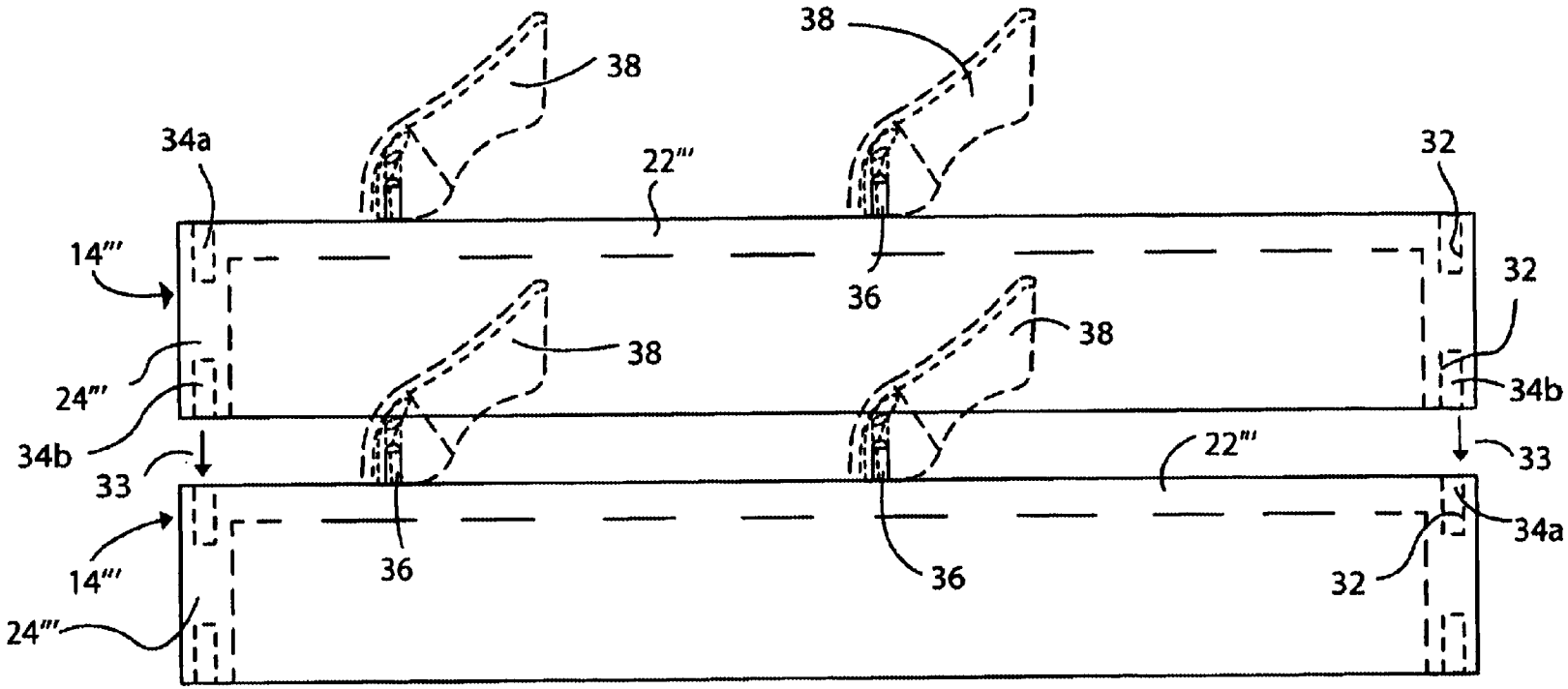
FIG. 11 is a side elevational view of two lower trays according to another embodiment of the present invention stacked upon one another.

In like manner, lower tray 14 is provided with four corner bores 32. Although bores 32 are shown to be of a cylindrical configuration, the present invention is not limited thereby, and bores 32 can have any other cross-sectional configuration, such as square, rectangular, polygonal, triangular, etc. Preferably, bores 32 extend along the entire height of lower side wall 24, although bores 32 can be of a lesser height. Magnets 34 having the same dimensions as bores 32 are friction fit within bores 32, with one end of each magnet 34 having a first polarity and the opposite end of each magnet 34 having an opposite polarity. For example, the end of each magnet 34 closest to upper facing edge 26 can have a South polarity while the end closest to bottom wall 22 can have a North polarity. Alternatively, two separate magnets 34*a* and 34*b* can be provided in each bore 32 with the aforementioned polarity arrangements, for example, as shown in FIG. 11.

Magnets 30 and 34 can be exposed or can be hidden beneath the fabric or other covering of the trays 12 and 14. Also, magnets 30 and 34 can be positioned anywhere along the side walls 18 and 24.

Bores 28 and 32 are arranged to be in alignment with each other when upper tray 12 is assembled on lower tray 14. In addition, the polarity of the ends of magnets 30 closest to lower facing edge 20 is opposite to the polarity of the ends of magnets 34 closest to upper facing edge 26. In this manner, there is a magnetic attraction force between these ends of magnets 30 and 34 in order to retain lower tray 12 and upper tray 14 in this assembled condition. Of course, this magnetic force can be overcome by a person prying the two trays 12 and 14 apart.

In like manner, the polarity of the ends of magnets 30 closest to top wall 16 is opposite to the polarity of the ends of magnets 34 closest to bottom wall 22. In the example given above, the ends of magnets 30 closest to top wall 16 would have a South polarity while the ends of magnets 34 closest to bottom wall 22 would have a North polarity. In this manner, there is a magnetic attraction force between these ends of magnets 30 and 34 when one storage box 10 is positioned on top of another storage box 10 in order to retain the storage boxes 10 in stacked relation. Of course, this magnetic force can be overcome by a person prying the two storage boxes 10 apart.

In accordance with another aspect of the present invention, the inner surface of bottom wall 22 is provided with a plurality of upwardly extending projections 36. Projections 36 are shown in the form of a plurality of pairs of pins, although the present invention is not limited thereby. For example, the number and spacing of the pins can be varied, and projections 36 other than pins can be used, such as bars, walls, etc. Preferably, the same projections 36 are provided as downwardly extending projections on the inner surface of top wall 16.

A plurality of article holding members 38 are provided, for removable engagement with projections 36 in order to hold articles thereon. In order to better explain this, article holding members 38 will be discussed in relation to various examples where the articles are jewelry, and display and storage box 10 is a jewelry display and storage box.

In one embodiment, each article holding member 38 is a ring finger 38*a* formed as a thin walled structure 40 in a part cylindrical or arcuate configuration that extends at an acute angle of, for example, 45 degrees, from a base section 42. Reinforcing columns 43 are connected between base section 42 and the rear surface of thin walled structure 40 for reinforcing thin walled structure 40. Each ring finger 38*a* is preferably made from a molded, flexible and lightweight plastic or rubber material, which can be covered by a fabric or cloth material.

Reinforcing columns 43 are provided with two parallel, spaced apart openings 44 for receiving a pair of pins 36 with a removable friction fit in order to removably mount ring finger 38*a* on upper tray 12 or lower tray 14. A ring (not shown) can then be placed on each ring finger 38*a*. In such case, the thin walled structure 40 of ring finger 38*a* can be compressed, and when a ring is positioned thereon, the thin walled structure 40 of ring finger 38*a*, which is resilient, will expand back outwardly so that the ring is securely held thereon. Ring .posts 38*a* can be formed in the same manner as U.S. Pat. Nos. 5,649,625; 6,059,098; 6,085,898; and 6,267,230, the entire disclosures of which are incorporated herein by reference.

The upper end of each ring finger 38*a* is open. Preferably, although not essential, the side edges of each ring finger 38*a* are cut-away to provide an arcuate edge 46. It will be appreciated that ring tags can be positioned behind ring fingers 38*a* and are therefore hidden for a clearer presentation.

In this regard, pins 36 are arranged such that ring fingers 38*a* mounted to lower tray 14 extend upwardly from bottom wall 22 toward top wall 16 when top wall 16 is positioned above bottom wall 22, as shown in FIG. 1 and ring fingers 38*a* mounted to upper tray 12 extend downwardly from top wall 16, with the ring fingers being arranged in a plurality of rows, with a spacing between ring fingers 38*a* of upper tray 12 and the spacing between ring fingers 38*a* of lower tray 14 being at least equal to a width of one ring finger 38*a*. Further, the ring fingers 38*a* of upper tray 12 fit between and are interleaved with the ring fingers 38*a* of lower tray 14 in the assembled condition of FIG. 1, in the same manner as taught in commonly owned U.S. Pat. Nos. 6,059,098; 6,085,898; and 6,267,230.

With the present invention, if one of the ring fingers 38*a* is damaged, for example, it is easy to remove it and replace the damaged ring finger 38*a* with a new ring finger. Further, if different style, size and/or shape ring fingers 38*a* are desired, it is easy to change the same.

Further, when upper tray 12 is removed, lower half 14 serves as an aesthetic display for the jewelry items. In order to carry or store the jewelry items, it is merely necessary to reinsert upper tray 12 with the aforementioned magnetic locking arrangement with lower tray 14.

Figure 5:
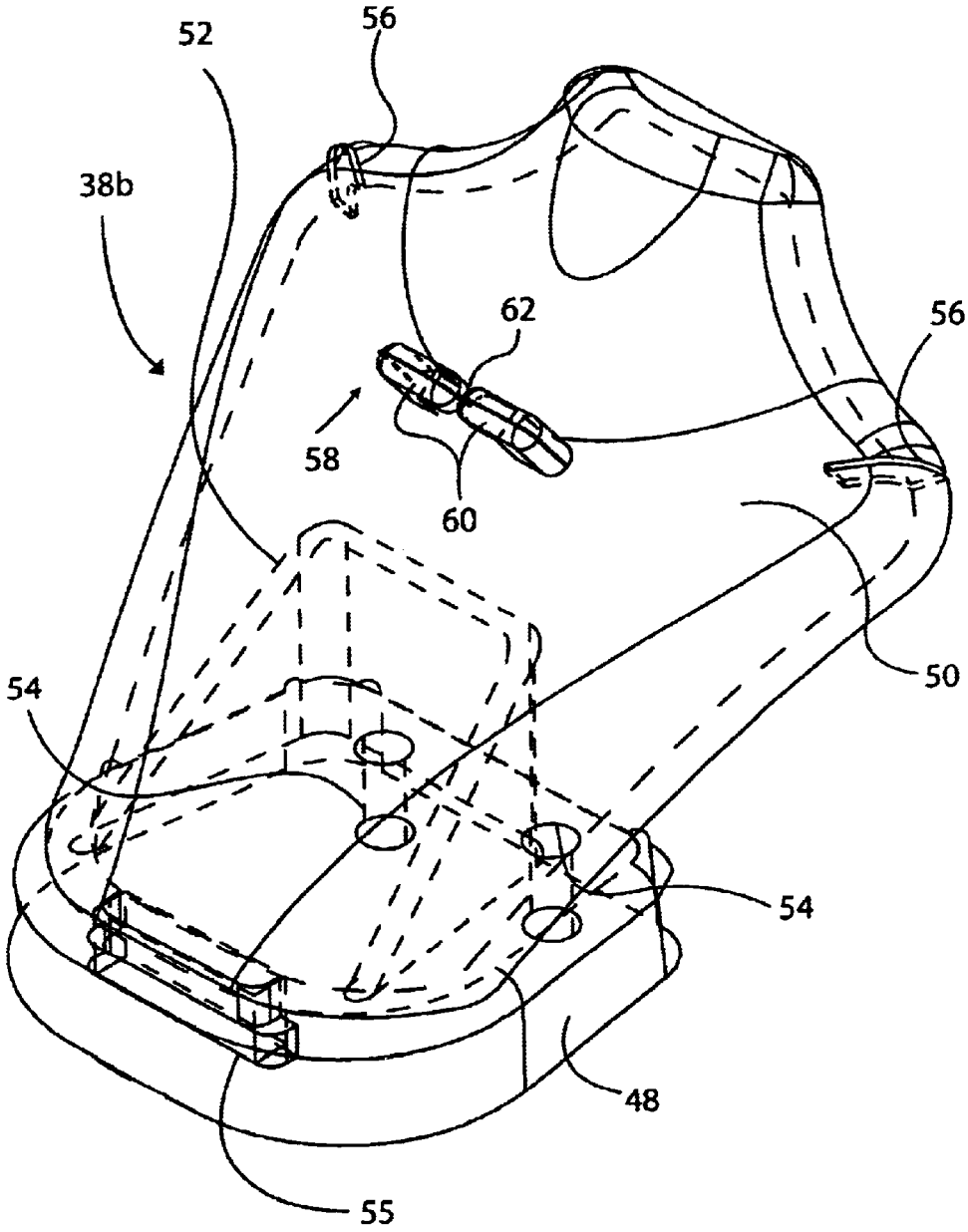
FIG. 5 is a perspective view of another jewelry holding member for holding a necklace and pendant, that can be used with the display and storage box according to the present invention.

As another example, another article holding member 38 that can be used with display and storage box 10 is shown in FIG. 5 as a necklace and pendant holder 38*b*. Necklace and pendant holder 38*b* includes a base section 48 and a torso and neck shaped portion 50 extending from base section 48 at an acute angle of, for example, 45 degrees. A U-shaped reinforcing wall 52 is connected between base section 48 and the rear surface of torso and neck shaped portion 50 for reinforcing torso and neck shaped portion 50 and maintaining the angular orientation thereof. Necklace and pendant holder 38*b* is preferably made from a molded, flexible and lightweight plastic or rubber material, which can be covered by a fabric or cloth material.

Base section 48 is provided with two parallel, spaced apart openings 54 for receiving a pair of pins 36 with a removable friction fit in order to removably mount necklace and pendant holder 38*b* on upper tray 12 or lower tray 14. In addition, an elongated opening 55 can be provided in spaced relation to openings 54 for receiving other pins 36 or a bar-like projection (not shown) to further removably hold necklace and pendant holder 38*b* on upper tray 12 and lower tray 14.

Each necklace and pendant holder 38*b* further includes necklace hold down members 56 at the shoulder portions thereof for receiving and holding down a necklace draped over the neck portion thereof. There is also provided a jewelry holding arrangement 58 at upper front portion of torso and neck shaped portion 50 for holding a pendant or pair of earrings. Jewelry holding arrangement 58 is preferably of the type described in U.S. Pat. No. 5,913,417, the entire disclosure of which is incorporated herein by reference. In this regard, jewelry holding arrangement 58 includes L-shaped fingers 60 having one end integrally formed with the upper surface of torso and neck shaped portion 50 and the other ends facing each other with a small gap 62 therebetween. Thus, the upper facing portions of L-shaped fingers 60 form a substantially continuous holder for a jewelry item, such as a pendant or earrings. Reference to an L-shape in relation to fingers 60 is intended to encompass various modifications thereof, such as fingers having the general shape of a quarter circle, a quarter oval, various bent configurations and the like.

Opposing fingers 60 can be separated due to the deformable nature thereof, with rabbit ears of the pendant or earrings being inserted so that fingers 60, due to the resilient nature thereof and after the biasing force thereon is removed, extend into the rabbit ears so as to removably secure the rabbit ears to torso and neck shaped portion 50. Thus, the rabbit ears are removably held by fingers 60.

Figure 6:
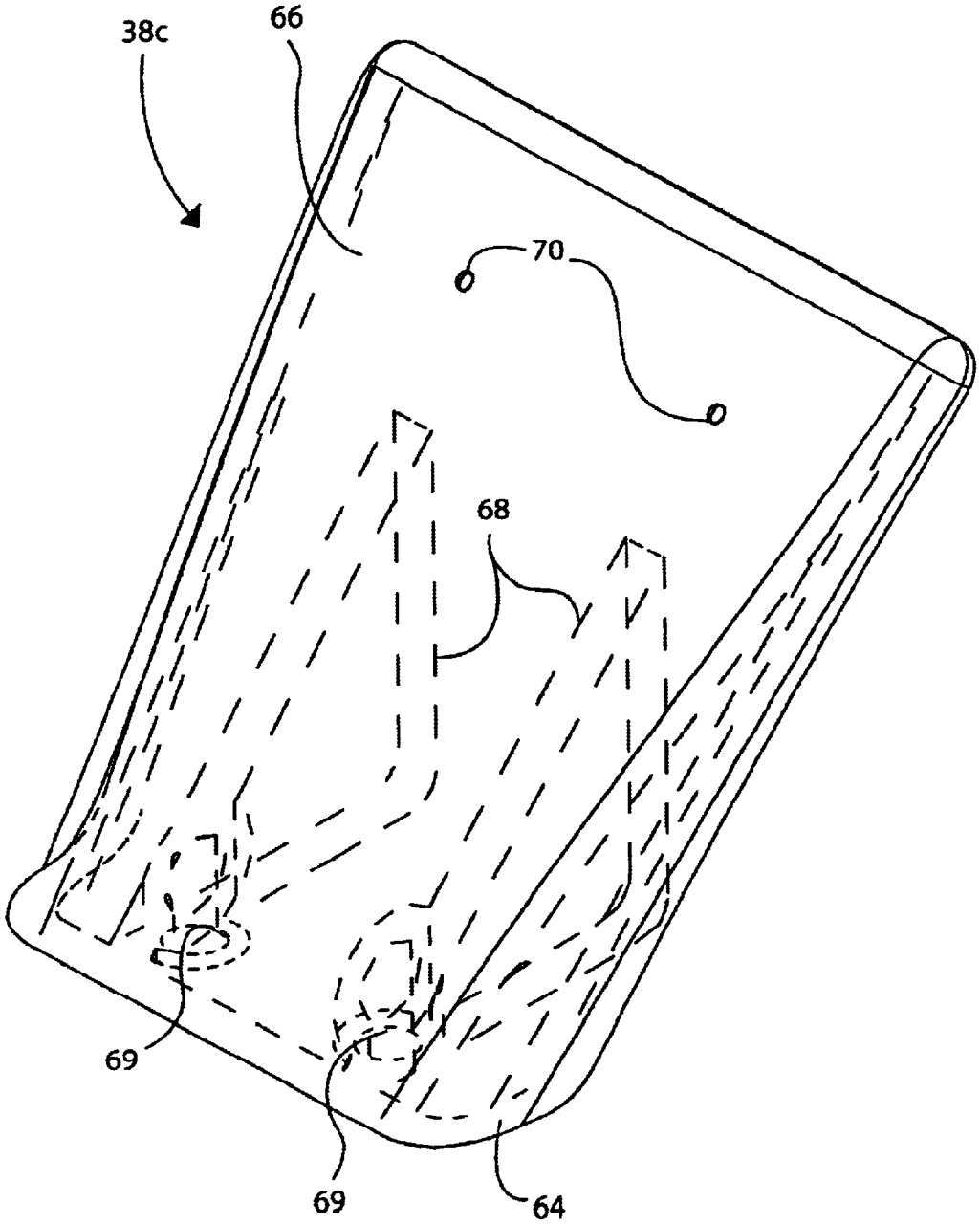
FIG. 6 is a perspective view of still another jewelry holding member for holding earrings, that can be used with the display and storage box according to the present invention.

As another example, another article holding member 38 that can be used with display and storage box 10 is shown in FIG. 6 as an earring holder 38*c*. Earring holder 38*c* includes a base section 64 and an inclined wall 66 extending from base section 64 at an acute angle of, for example, 45 degrees. Triangular reinforcing walls 68 are connected between base section 64 and the rear surface of inclined wall 66 for maintaining the angular orientation thereof. Earring holder 38*c* is preferably made from a molded, flexible and lightweight plastic or rubber material, which can be covered by a fabric or cloth material.

Base section 64 is provided with two parallel, spaced apart openings 69 for receiving a pair of pins 36 with a removable friction fit in order to removably mount earring holder 38*c* on upper tray 12 or lower tray 14. Each earring holder 38*c* further includes two openings 70 at the upper portion of inclined wall 66 for receiving a set of two pierced earrings therethrough.

Figure 9:
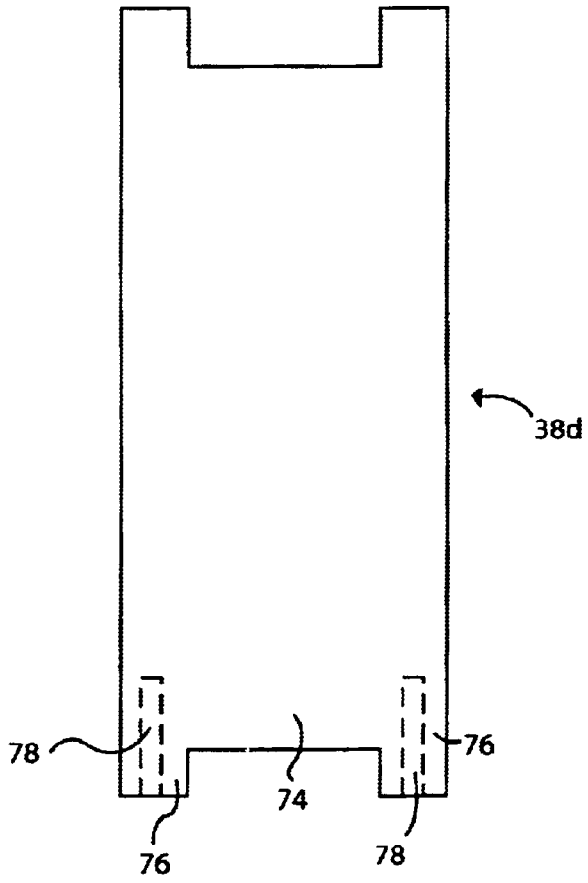
FIG. 9 is a front elevational view of a modified article holding member 38*d* for holding a watch.

It will be appreciated that, while the present invention has been discussed in relation to specific jewelry holding members 38*a*–38*c*, other jewelry holding members can be used. For example, a watch holder 38*d* can be provided as a jewelry holding member. As shown in the elevational view of FIG. 9, watch holder 38*d* includes a C-shaped or arcuate central section 74 for holding a watch therearound, and two opposite side sections 76, with openings 78 provided in at least one portion of side sections 76 for receiving pins 36 such that central arcuate section 74 extends up to better display the watch. Of course, in this case, the spacing between pins 36 would be greater than that shown in the previous embodiments.

Further, the present invention is not limited to holding jewelry items, and other article holding members 38 can be used for holding articles other than jewelry.

It will be appreciated that the reverse of the present pin arrangement, that is, the pins 36 on the article holding member 38 and the openings in the tray 12 or 14 is not practical since it greatly increases the thickness, weight and cost of the walls of the trays containing the openings.

Figure 7:
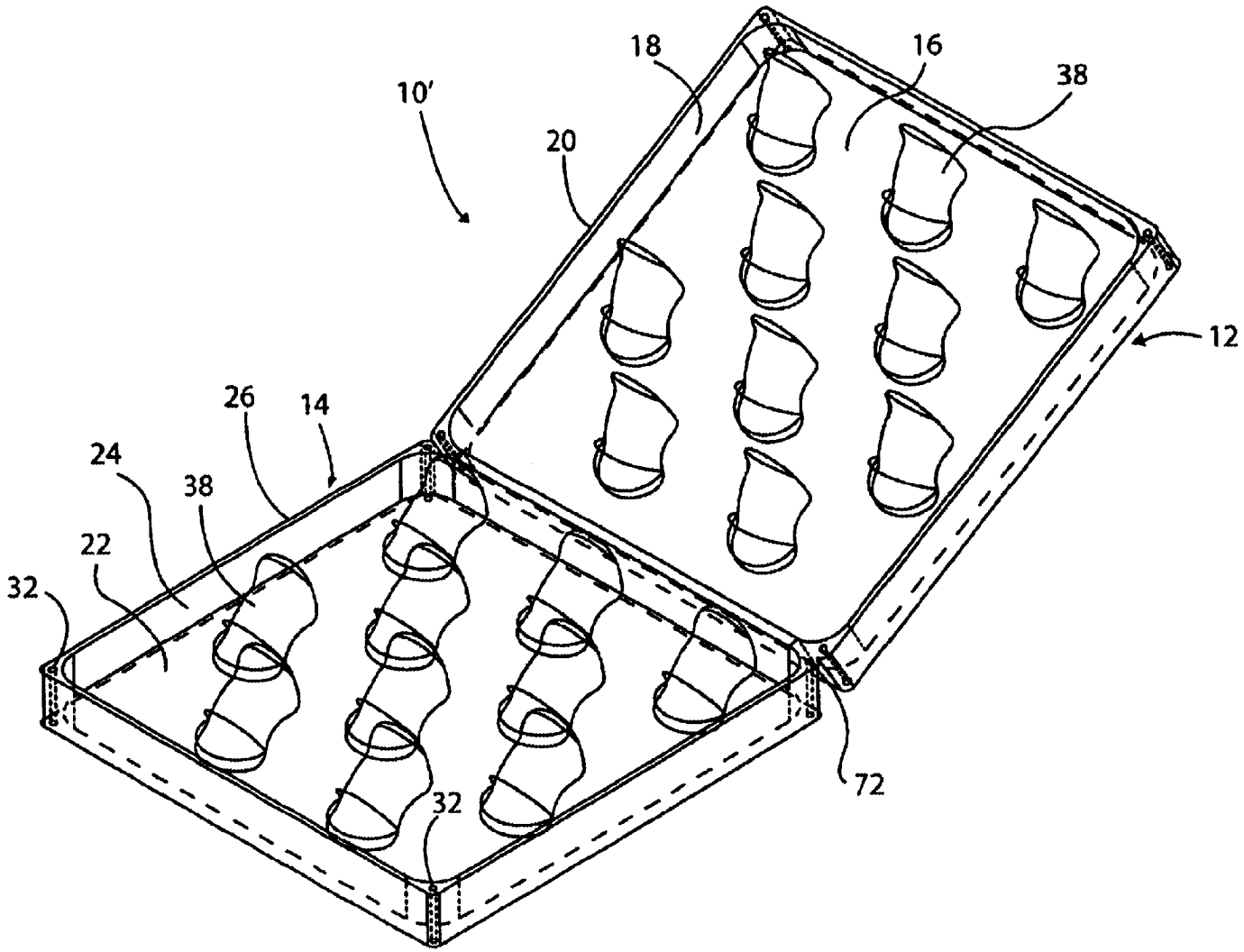
FIG. 7 is a perspective view of a hinged display and storage box according to a modification of the present invention, in an open condition.

Although the present invention has been discussed in relation to a separated upper tray 12 and lower tray 14, it will be appreciated that upper tray 12 and lower tray 14 can be hinged at one edge thereof by a hinge structure 72, for example, a separate hinge, a living hinge, etc. as shown by modified display and storage box 10' in FIG. 7. In such case, when display and storage box 10' is in a closed configuration, magnets 30 and 34 serve to retain display and storage box 10' in this closed configuration, subject to an overcoming force being applied by a user to open the same.

Figure 10:
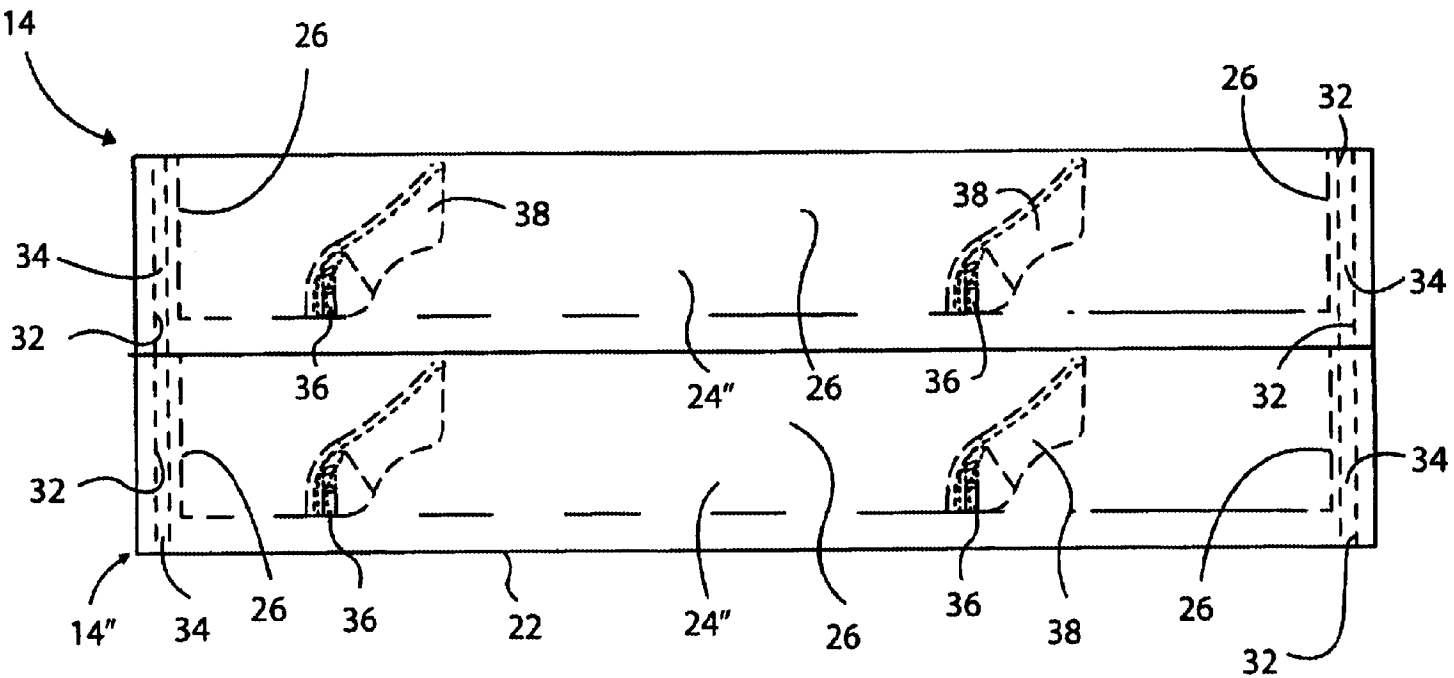
FIG. 10 is a side elevational view of lower trays stacked one upon another, with the side walls extending to a height greater than the height of the article holding members.

It will be appreciated that the side wall 24" can extend to a height greater than the height of the article holding members 38 so that only lower trays 14" need be used and can be stacked one upon another, as shown in FIG. 10.

As a further alternative to using only lower trays, the side walls 24'" can extend below supporting walls 22'" so that each supporting wall 22'" is raised up. In such case, there is a cavity below supporting wall 22'" and defined by lower extending side wall 24'". In such case, projections 36 would extend upwardly from the upper surface of supporting wall 22'", that is, opposite to the cavity side, and a plurality of such lower trays 14'" can be stacked one upon another, as shown by arrows 33 in FIG. 11, in which the article holding members 38 from a lower tray 14'" extend into the cavity of a tray 14'" mounted thereon.

Of course, it will be appreciated that the pins 36 can be of various heights, shapes and dimensions to display he article holders 38 in different positions and heights.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A portable display box comprising:

a supporting wall having a substantially planar surface;

a side wall extending from a periphery of the supporting wall;

a plurality of pairs of spaced apart pins extending upwardly from the substantially planar surface of the supporting wall within a boundary of the side wall; and at least one article holding member, each article holding member having an underside surface and a pair of spaced apart openings in the underside surface thereof for receiving at least one pair of said pins such that said at least one pair of pins alone to removably secures the respective article holding member on the substantially planar surface of the supporting wall.

2. A display box according to claim 1, wherein each article holding member includes a base portion having said underside surface with said pair of spaced apart openings, and an upstanding portion extending from said base portion for holding an article thereon.

3. A display box according to claim 2, wherein said upstanding portion includes an arrangement for holding a jewelry item thereon.

4. A display box according to claim 3, wherein said upstanding portion includes at least one opening for holding a pierced earring.

5. A display box according to claim 3, wherein said upstanding portion includes at least one finger for holding a pendant.

6. A display box according to claim 3, wherein said upstanding portion includes an at least part arcuate structure for holding a ring.

7. A display box according to claim 2, wherein each article holding member further includes a reinforcing member formed as at least one upstanding wall connected between the base portion and an underside of the upstanding portion to reinforce the upstanding portion, the at least one upstanding wall including two spaced apart openings in alignment with the pair of spaced apart openings in the underside surface of the article holding member for receiving at least one pair of said pins.

8. A display box according to claim 2, wherein the upstanding portion extends from said base portion at an acute angle.

9. A display box according to claim 2, wherein each article holding member further includes a reinforcing member formed as a U-shaped upstanding wall connected between the base portion and an underside of the upstanding portion to reinforce the upstanding portion.

10. A display box according to claim 1, wherein the side wall extends one of:

downwardly relative to said supporting wall; and upwardly relative to said supporting wall.

11. A display box according to claim 1, wherein said side wall has magnetic members mounted therein which have their magnetic poles oriented in a manner to attract magnetic members in side walls of another said display box in stacked relation therewith.

12. A display box according to claim 11, wherein said magnet members are arranged at periodic intervals along the side wall.

13. A display box according to claim 11, wherein the side wall has corner sections, and the magnets are positioned at the corner sections.

14. A portable display and storage box comprising:

an upper portion including:

a top wall having a lower substantially planar surface, and an upper side wall extending down from the top wall;

a lower portion which together with the upper portion defines a closed box in an assembled configuration, the lower portion including:

a bottom wall having an upper substantially planar surface, and a lower side wall extending up from the bottom wall;

a plurality of pairs of spaced apart pins extending inwardly from the substantially planar surface of at least one of the bottom wall and top wall within a boundary of the side wall of the respective one of the bottom wall and top wall; and at least one article holding member, each article holding member having an underside surface and a pair of spaced apart openings in the underside surface thereof for receiving at least one pair of said pins such that said at least one pair of pins alone to removably secures the respective article holding member on the substantially planar surface of a respective one of the upper portion and lower portion.

15. A display box according to claim 14, wherein each article holding member includes a base portion having said underside surface with said pair of spaced apart openings, and an upstanding portion extending from said base portion for holding an article thereon.

16. A display and storage box according to claim 15, wherein said upstanding portion includes an arrangement for holding a jewelry item thereon.

17. A display and storage box according to claim 16, wherein said upstanding portion includes at least one opening for holding a pierced earring.

18. A display and storage box according to claim 16, wherein said upstanding portion includes at least one finger for holding a pendant.

19. A display and storage box according to claim 16, wherein said upstanding portion includes an at least part arcuate structure for holding a ring.

20. A display and storage box according to claim 15, wherein the at least one article holding member further includes a reinforcing member for connection between the base portion and the upstanding portion to reinforce the upstanding portion.

21. A display and storage box according to claim 15, wherein the upstanding portion extends from said base portion at an acute angle.

22. A display and storage box according to claim 14, wherein the substantially planar surface of both the bottom wall and top wall having said plurality of said pairs of spaced apart pins thereon, and the pins are arranged on the bottom wall and top wall such that article holding members retained on the bottom wall are interleaved with article holding members retained on the top wall when the upper portion and lower portion are assembled together in a closed box configuration.

23. A display and storage box according to claim 14, wherein each of said upper portion and lower portion have magnetic members mounted therein which have their magnetic poles oriented in a manner to attract the lower portion and upper portion toward each other when assembled together in a closed box configuration.

24. A display and storage box according to claim 23, wherein said magnet members are arranged at periodic intervals along the upper side wall and lower side wall.

25. A display and storage box according to claim 23, wherein the upper portion and lower portion each have corner sections, and the magnets are positioned at the corner sections.

26. A display and storage box according to claim 23, wherein the magnets have their magnetic poles oriented in a manner to attract a second said display and storage box stacked thereon.

27. A display and storage box according to claim 14, wherein the upper portion and lower portion are hinged together by a hinge at a common edge.

* * * * *